US005805189A

United States Patent [19]

Edelhof

[11] Patent Number: 5,805,189

[45] Date of Patent: Sep. 8, 1998

[54] DEVICE FOR FLUID SUPPLY OF A MICRO-METERING DEVICE

[75] Inventor: Jörg Edelhof, Berlin, Germany

[73] Assignee: Eastman Kodak Company, Rochester, N.Y.

[21] Appl. No.: 568,052

[22] Filed: Dec. 6, 1995

[30] Foreign Application Priority Data

Dec. 6, 1994 [DE] Germany ..... 44 43 290.9

[51] Int. Cl.[6] ..... B41J 2/175; B65D 88/54

[52] U.S. Cl. ..... 347/87; 347/86; 222/282

[58] Field of Search ..... 347/86, 87, 88; 222/282, 137; 417/322

[56] References Cited

U.S. PATENT DOCUMENTS

| | | | |
|---|---|---|---|
| 4,271,989 | 6/1981 | O'Neill et al. | 222/282 |
| 4,794,409 | 12/1988 | Cowger et al. | 346/140 R |
| 5,040,002 | 8/1991 | Pollacek et al. | 346/140 R |
| 5,365,262 | 11/1994 | Hattori et al. | 347/87 |

FOREIGN PATENT DOCUMENTS

| | | | |
|---|---|---|---|
| 0 441 458 A1 | 8/1991 | European Pat. Off. | B41J 2/175 |
| 0 560 729 A2 | 9/1993 | European Pat. Off. | B41J 2/175 |

*Primary Examiner*—Peter S. Wong
*Assistant Examiner*—Rajnikant B. Patel
*Attorney, Agent, or Firm*—Milton S. Sales

[57] ABSTRACT

A micro-metering device 12 is subdivided into a fluid supply container 15 and a fluid compartment 14 by a partition wall 22. The partition wall 22 is at a distance from a housing wall 11*c* accommodating a metering module 16 such that the fluid 13 is conveyed inside the intermediate area to the metering module by capillary forces. The fluid 13 is stored in a bag 19 inside the fluid supply container 15 and passes at least one supply opening 20 in the partition wall 22 into the fluid compartment 14.

11 Claims, 2 Drawing Sheets

DEVICE FOR FLUID SUPPLY OF A MICRO-METERING DEVICE

BACKGROUND OF THE INVENTION

1. Technical Field

This invention relates generally to a device for fluid supply inside a micro-metering device for ink print heads.

2. Background Art

To store the ink or writing fluid, many of the known ink print heads, such as EP-A-O 441 458, utilize a sponge structure that is subject to a variety of geometric changes, resulting from the action of the ink, that might lead to operational problems or failures of the ink print heads. The following possible solutions have been proposed in the prior art for partially or completely dispensing with the sponge structure in an ink print head.

U.S. Pat. No. 4,794,409 discloses an ink print head having first and second ink supply compartments that are connected to one another by a sponge. The sponge also provides a connection to the print head, which has a filter on the side facing the sponge. In a normal temperature and pressure range, the ink runs directly from the first ink supply compartment to the print head. At temperatures or pressures outside the normal range, the second ink supply compartment absorbs or discharges ink from or to the sponge. The second ink compartment serves virtually as a buffer to prevent the leakage at the print head.

U.S. Pat. No. 5,040,002 describes the use of a regulating valve in an ink print head that keeps the ink inside a bulb. The bulb collapses on itself when emptied. The bulb is fitted above the print module and is subjected to atmospheric pressure via an opening provided in the housing wall. The ink flow to the print module is made possible by an opening, on the underside of which is located the regulating valve. The regulating valve is used mainly to prevent an ink discharge through the print module. Since the ink supply to the print head is of the gravity type, the print head can only be fitted inside an ink jet printer with the print direction downwards.

DISCLOSURE OF THE INVENTION

The object of the present invention is to provide a device ensuring a constant fluid supply of the dosing module even in changing external conditions such as temperature, air pressure, or dynamic loading.

A further object of the present invention is to achieve an optimum fluid yield, i.e. to use almost all the fluid present inside the micro-metering device. Furthermore, the micro-metering device should be designed such that it can be filled with fluid several times.

This is achieved in accordance with the present invention by a partition wall provided between the fluid supply container and the fluid compartment such that the distance between the partition wall and a housing wall accommodating the metering module is dimensioned so that the fluid is conveyable to the metering module by means of capillary forces.

The advantage of the present invention is that the risk of a fluid leak at the metering module is considerably reduced by the capillary fluid supply to the print module.

Furthermore, the present invention permits a considerably greater use of the fluid present in the supply compartment, and the micro-metering device can be filled several times.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The following description of the invention is confined to the embodiment in which the fluid supply of an ink print head is disclosed. It is, however, clear to anyone skilled in the art that other devices can also apply to the proposed solution in accordance with the invention for micro-fine metering of those fluids that evaporate without leaving residues. A further example of this is micro-pumps based on a bubble-jet print head, which permit fine and precise fluid metering.

In the following description of the ink print head, the designations specific to this technology are used. The ink print head, therefore, corresponds to the micro-metering device, ink supply to the fluid supply, the ink supply container to the fluid supply container, the ink compartment to the fluid compartment, the ink bag to the bag, the writing fluid to the fluid, and the print module to the metering module.

Figure 1:
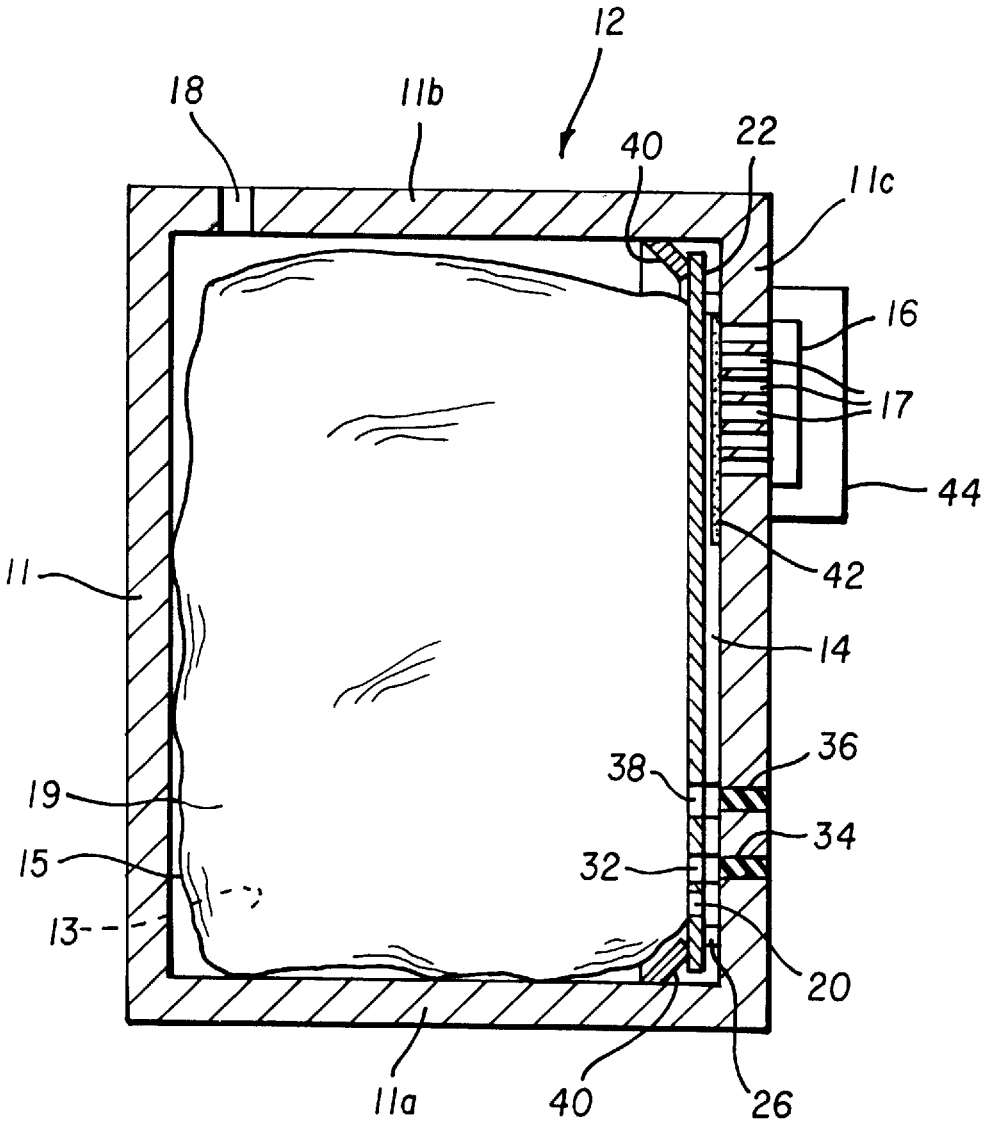
FIG. 1 is a cross-section through the ink print head, with the ink bag completely filled.

Referring to FIG. 1, an ink print head 12 includes a housing 11 consisting of a lower housing wall 11*a*, an upper housing wall 11*b*, and four lateral housing walls (not all explicitly illustrated). One wall 11*c* of the four lateral housing walls accommodates a print module 16 fitted near upper housing wall 11*b*. A vent opening 18 is provided in upper housing wall 11*b* to ensure pressure equalization inside ink print head 12.

Ink print head 12 is divided by a partition wall 22 into an ink supply container 15 and an ink compartment 14. Ink supply container 15 contains an ink bag 19 filled with writing fluid 13. Ink bag 19 is made of an ink-resistant film material with additional metallized coating to make ink bag 19 largely diffusion-proof. Aluminum is preferably selected for metallization. The ink bag can be connected by conventional techniques such as gluing, welding, stamping, etc. to that side of partition wall 22 facing away from print module 16. Partition wall 22 is at a distance from housing wall 11*c* accommodating the print module, such that the movement of writing fluid 13 inside ink compartment 14 is by capillary force. The distance from partition wall 22 to housing wall 11*c* is fixed using spacers 26. The capillary fluid is conveyed in the embodiment shown here from lower housing wall 11*c* in the direction of upper housing wall 11*b*.

At least one supply opening 20 in partition wall 22 provides a connection between the supply of writing fluid 13 in ink bag 19 and ink compartment 14. Writing fluid 13 can flow additionally into ink compartment 14 through the supply opening. The ink print head embodiment shown here also has, besides supply opening 20, a vent opening 38 and a filler opening 32. Both these openings provide a connection from the outside to the inside of the ink bag 19. The filler opening 32 and the vent opening 38 are designed to be sealable using plugs 34, 36. The vent opening 38 and the filler opening 32 are designed such that repeated filling is possible. The plugs 34, 36 are, for example, made from pre-stamped rubber. Openings 20 are arranged in a row and as close as possible to the lower housing wall 11*a* or to the lowest point of ink bag 19 in order to achieve almost complete emptying of the ink bag 19. Above supply opening 20 are the filler opening 32 and vent opening 38.

Ink supply container 15 and ink compartment 14 are separated from one another by a seal 40 along the circumference of partition wall 22 in a completely fluid-tight manner. Writing fluid 13 conveyed from supply opening 20 in the direction of print module 16 passes via a filter 42 through at least one opening 17 into the area of print module 16 in which the ink droplets are generated. To protect print module 16 from damage, it is provided with a cover 44.

Figure 2:
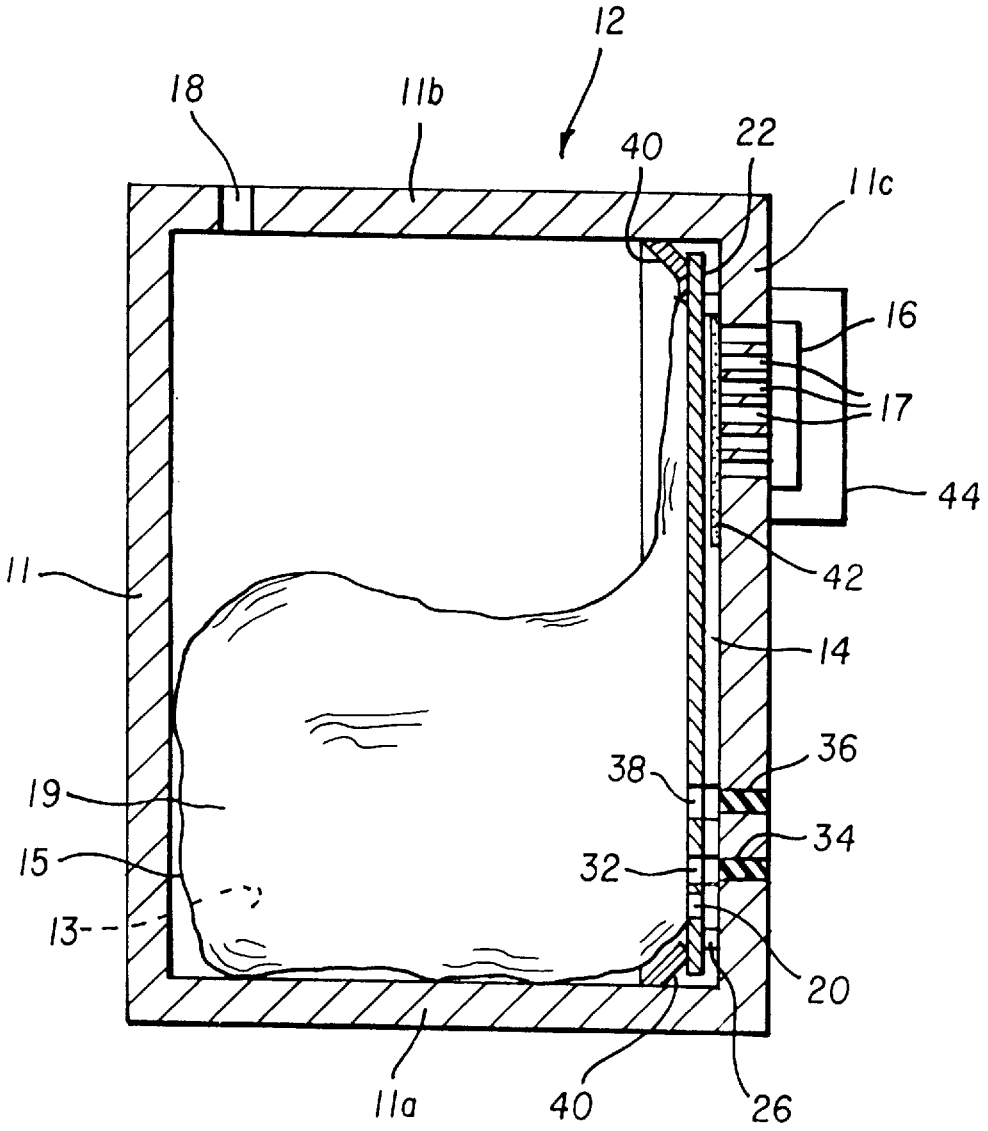
FIG. 2 is a cross-section through the ink print head, with the ink bag partly emptied.

FIG. 2 shows ink print head 12 from FIG. 1, with a certain quantity of writing fluid 13 already having been used up. Vent opening 18 provided in upper housing wall 11*b* ensures pressure equalization between the ambient pressure and the pressure inside the ink supply container. The pressure differences can be caused by writing fluid consumption, temperature changes or pressure changes. The pressure equalization by vent opening 18 causes ink bag 19 to collapse on itself, depending on the quantity used of writing fluid 13. When the emptied ink bag 19 is refilled, the air compressed by the filling operation inside ink supply container 14 can escape through the vent opening 18.

The invention has been described in detail with particular reference to preferred embodiments thereof, but it will be understood that variations and modifications can be effected within the spirit and scope of the invention.

What is claimed is:

1. A micro-metering device comprising:

a metering module;

a housing which is subdivided into a fluid supply container and a fluid compartment, wherein said fluid compartment is connected via at least one opening to the metering module;

a bag filled with fluid in said fluid supply container, the bag being connected to said fluid compartment;

a housing wall supporting said metering module; and a partition wall between said fluid supply container and said fluid compartment, the distance between said partition wall and the housing wall is such that said fluid is conveyable to said metering module by means of capillary forces.

2. The micro-metering device according to claim 1, further comprising an upper housing wall, a lower housing wall, and a plurality of side walls; wherein said partition wall comprises:

a plate connected in fluid-tight manner to the upper housing wall, the lower housing wall, and the side walls;

spacers for keeping the partition wall at a distance from a side wall such that capillary forces effect the conveying of said fluid.

3. The micro-metering device according to claim 1, further comprising a supply opening which, in the installed state of said micro-metering device, is beneath the at least one opening to said metering module.

4. The micro-metering device according to claim 2:

further comprising a supply opening which, in the installed state of said micro-metering device, is beneath the at least one opening to said metering module, close to said lower housing wall, and wherein the at least one opening to said metering module is close to said upper housing wall containing said vent opening.

5. The device according to claim 1, wherein said bag consists of a thin film, such that said bag collapses when emptied.

6. The device according to claim 5, wherein said bag is diffusion-proof.

7. The device according to claim 6, wherein said bag has a metal coating of aluminum on its outside.

8. The device according to claim 1, wherein:

said bag in said fluid supply container is refillable via a filter opening provided on said housing wall and sealable using a first plug; and said filler opening is connected through said housing wall and said partition wall to the inside of said bag.

9. The device according to claim 8, wherein a vent opening, sealable using a second plug, is connected through said housing wall and said partition wall to the inside of said bag.

10. The device according to claim 9, wherein:

said vent opening is arranged above said filler opening and said filler opening above said supply openings; and said supply openings are aligned in a row.

11. The device according to claim 1, wherein said metering module is provided on said housing wall close to said upper housing wall.

* * * * *